United States Patent [19]

Keritsis

[11] Patent Number: 4,532,945

[45] Date of Patent: Aug. 6, 1985

[54] PROCESS FOR INCREASING AND MAINTAINING THE FILLING POWER OF TOBACCO

[75] Inventor: Gus D. Keritsis, Richmond, Va.

[73] Assignee: Philip Morris Incorporated, New York, N.Y.

[21] Appl. No.: 542,247

[22] Filed: Oct. 14, 1983

[51] Int. Cl.[3] ..... A24B 3/18

[52] U.S. Cl. ..... 131/291; 131/296; 131/903

[58] Field of Search ..... 131/900, 355, 903, 291, 131/292–296

[56] References Cited

U.S. PATENT DOCUMENTS

| | | | |
|---|---|---|---|
| 2,596,183 | 5/1952 | Sowa | 131/291 |
| 2,656,841 | 10/1953 | Gurley, Jr. | 131/291 |
| 2,887,414 | 5/1959 | Rosenberg et al. | 131/355 |
| 3,106,212 | 10/1963 | Halter et al. | 131/291 |
| 3,317,513 | 5/1967 | Rice | 260/214 |
| 3,349,080 | 10/1967 | Hiatt et al. | 260/225 |
| 3,409,022 | 11/1968 | de la Burde | 131/291 |
| 3,409,023 | 11/1968 | de la Burde | 131/291 |
| 3,413,130 | 6/1965 | Rose | 99/176 |
| 3,421,519 | 1/1969 | Moshy | 131/291 |
| 3,425,425 | 2/1969 | Hind | 131/291 |
| 3,511,244 | 11/1970 | Kurilla | 128/335.5 |
| 3,524,451 | 8/1970 | Fredrickson | 131/291 |
| 3,524,452 | 8/1970 | Stewart et al. | 131/291 |
| 3,526,048 | 9/1970 | Rowland et al. | 38/144 |
| 3,529,606 | 9/1970 | de la Burde et al. | 131/291 |
| 3,556,112 | 1/1971 | de la Burde et al. | 131/291 |
| 3,589,364 | 6/1971 | Dean et al. | 128/284 |
| 3,734,104 | 5/1973 | Buchanan et al. | 131/291 |
| 3,842,846 | 10/1974 | Laszlo | 131/291 |
| 3,931,824 | 1/1976 | Miano et al. | 131/291 |
| 3,978,867 | 9/1976 | Wochnowski | 131/291 |
| 3,982,550 | 9/1976 | de la Burde et al. | 131/291 |
| 4,044,780 | 8/1977 | Kelly | 131/291 |
| 4,072,155 | 2/1978 | McGeady | 131/903 |
| 4,195,647 | 4/1980 | Wochnowski et al. | 131/291 |
| 4,235,250 | 11/1980 | Utsch | 131/291 |
| 4,250,898 | 2/1981 | Utsch et al. | 131/291 |
| 4,258,729 | 3/1981 | de la Burde et al. | 131/291 |
| 4,266,562 | 5/1981 | Merritt et al. | 131/293 |
| 4,274,427 | 6/1981 | Lendvay | 131/293 |
| 4,333,484 | 6/1982 | Keritsis | 131/359 |
| 4,341,228 | 7/1982 | Keritsis et al. | 131/291 |

FOREIGN PATENT DOCUMENTS

| | | |
|---|---|---|
| 977235 | 11/1975 | Canada . |
| 730629 | 12/1973 | South Africa . |
| 1331640 | 9/1973 | United Kingdom . |
| 1444309 | 7/1976 | United Kingdom . |
| 1203939 | 9/1979 | United Kingdom . |
| 2028096A | 3/1980 | United Kingdom . |

*Primary Examiner*—V. Millin

[57] ABSTRACT

A process for increasing and maintaining the filling power of tobacco, in which an effective amount of at least one cross-linking agent is applied to the tobacco and reacted with various components therein. The cross-linking agent may be applied directly or in the form of a solution, and is preferably employed in conjunction with an expansion treatment of the tobacco.

8 Claims, No Drawings

PROCESS FOR INCREASING AND MAINTAINING THE FILLING POWER OF TOBACCO

FIELD OF THE INVENTION

This invention relates to the art of increasing the filling power of tobacco filler. More particularly, this invention is directed to a process whereby cross-linking agents are applied to tobacco and are reacted with various components therein to increase and maintain the filling power of the tobacco.

BACKGROUND OF THE INVENTION

Reduction of the moisture content of tobacco leaves during the curing process results in shrinkage of the leaf structure and a decrease in filling power. Shredding or cutting of the cured tobacco leaves to prepare filler may result in lamination and compression of the tobacco, thereby leading to an even greater filling power decrease.

Many procedures have been devised for increasing the filling power of cured tobacco. In particular, a large number of processes have been developed whereby the tobacco is impregnated with a solid, liquid or gaseous impregnant which, when removed during a subsequent expansion process step, generates elevated pressure in the tobacco cells, thereby expanding the cell walls. Such processes provide tobacco products of substantially increased filling power with an associated reduction in the total amount of tobacco used in, e.g., the preparation of a cigarette rod.

Most of the known processes, however, do not guarantee that the expanded bulk volume of the filler tobacco is retained over long periods of time such that, after casing, the firmness of the tobacco rod as packed would not be lost. For example, it is known that puffing of tobacco constituents through the application of high pressure steam followed by a sudden release of pressure does not necessarily lead to the retention of their expanded form. Loss of the expanded state and firmness over time is believed due to plasmolysis and cell contraction occurring during drying stages, which tend to cause the expanded tobacco to return to its original form.

DEFINITIONS

As used herein, the following terms have the indicated meanings.

Filling Power: the ability of tobacco to form a firm cigarette rod at a given moisture content. A high filling power indicates that a lower weight of tobacco is required to produce a cigarette rod than is required with tobacco of lower filling power.

Cylinder Volume (CV): the volume that a given weight of shredded tobacco occupies under a definite pressure. The CV value is expressed as cc/10 g. To determine this value, tobacco filler weighing 10.000 g is placed in a 3.358-cm diameter cylinder, vibrated for 30 seconds on a "Syntron" vibrator, and compressed by a 1875 g piston 3.33 cm in diameter for 5 minutes. The resulting volume of filler is reported as cylinder volume. This test is carried out at standard enviromental conditions of 23.9° C. and 60% relative humidity (RH). A high cylinder volume indicates a high filling power.

Oven-Volatiles Content (OV): a unit indicating the moisture content (or percentage of moisture) in tobacco filler. It is determined by weighing a sample of tobacco filler before and after exposure in a circulating air oven for three hours at 100° C. The weight loss as a percentage of initial weight is the oven-volatiles content. The weight loss is attributable to volatiles in addition to water; nonetheless, since not more than about 1% of the tobacco filler weight is volatiles other than water at the test conditions, OV is used interchangeably with moisture content and may be considered equivalent thereto.

Equilibrium Oven-Volatiles Content ($OV_{equil}$): the OV value determined after the tobacco filler has been equilibrated by conditioning at 23.9° C. and 60% RH for 18 hours.

DESCRIPTION OF THE INVENTION

It is an object of the instant invention to increase the wet and dry strength of tobacco, particularly tobacco filler and reconstituted tobacco and reduce breakage during normal processing.

An additional object of the invention is to stabilize and stiffen tobacco filler, especially when in expanded form, and to increase the filling capacity of the filler when used in the production of, e.g., cigarettes, independent of the moisture content and the effects of casing with humectants and flavors. In this manner, the cigarette density and weight may be reduced while acceptable cigarette firmness and resistance-to-draw are maintained.

A further object of the invention is to protect the various fillers from collapsing or softening during smoking.

Still another object of the invention is to reduce bulk density and compressibility of the tobacco at the cutters and cigarette making machines, thereby making these materials easier to cut and to permit the manufacture of cigarettes without damage to the equipment. In addition, a reduction or elimination in tackiness reduces machine blockages and build-up during normal filler or final product preparation.

These and other objects can be achieved according to the instant invention, in which a cross-linking agent is added to tobacco and the agent reacted with the tobacco. The reaction is carried out by heating the treated tobacco. The cross-linking agent is one which contains the appropriate functional groups to react with the free functional groups of components in the tobacco. In general, the reactions which take place between the tobacco components and the cross-linking agents are known. The reactions and the ratio of the functional groups in the tobacco to the functional groups in the cross-linking agent can be manipulated to produce the desired degree of rigidity and the amount of polyfunctional cross-linking bridges introduced.

The tobacco is selected from the group consisting of tobacco leaf, cured tobacco leaf, tobacco filler, and reconstituted tobacco.

The cross-linking agents of the present invention are (a) polyfunctional acids (two or more carboxylic groups); (b) acid chlorides of polyfunctional carboxylic acids (e.g., adipoyl chloride); (c) acid anhydrides of polyfunctional carboxylic acids; (d) carbonyl chloride; (e) aldehydes and dialdehydes; (f) $(NH_4)_2HPO_4$; (g) ketenes; (h) lactones; (i) azides and diazides; (j) aldehydic and keto sugars (glucose, fructose, dextrose, etc.); (k) polybasic inorganic acids and salts thereof; and (l) amides. Preferred polyfunctional carboxylic acids include citric, maleic, malic, malonic, ethylenediamine tetracetic, polymannuronic, polygalacturonic, adipic, azelaic, tartaric and succinic acids. Preferred polybasic inorganic acids include phosphoric, hypophosphorous and sulfuric acids and the ammonium and alkali metal salts thereof. Diammonium phosphate is a preferred cross-linking agent, particularly in combination with a polyfunctional carboxylic acid. When a dialdehyde is employed as the cross-linking agent, the use of a polybasic inorganic acid in combination therewith is specifically excluded. Also excluded are metal salts of polyfunctional carboxylic acids.

The rigidity of the final product can be controlled by the degree of heat treatment and the amount and degree of polyfunctionality of the particular cross-linking agent employed. Generally, the reactions take place at relatively moderate temperatures and times, preferably at 25° to 350° C. and from a few seconds to 120 minutes and do not require a catalyst. In addition, higher temperatures, or combinations of temperature and concentration can be used to shorten the time needed to achieve the desired results. One particularly effective technique comprises a brief exposure of the treated tobacco to a high temperature, for example, over 260° C.

The cross-linking agent is generally applied to the tobacco in an amount between about 0.5 and 10 weight percent relative to the tobacco. Preferably, the rate of application is between about 1 and 5 wt-%. The cross-linking agents may be applied directly or in the form of a solution.

In the case of reconstituted tobacco, the cross-linking agent is applied to the surface of the reconstituted tobacco material either before or during preparation of cigarette filler from the material. The surface can be treated by spraying, dipping or coating techniques, and with reconstituted tobacco sheet, it is preferable that only one of the sheet surfaces be treated to introduce different shrinkage characteristics to the threshed or shredded sheets. Upon drying, the treated reconstituted tobacco particles will tend to curl, thus increasing the blend CV and reducing bulk density and cigarette weight.

As a further refinement of this process, binders or gums could also be used to coat the sheet surface. These binders or gums could be water soluble, solvent soluble or thermoplastic in nature, and are caused to adhere to the tobacco through pressure, heat or both. In the case where the binder or gum is water soluble, it could be converted into a water-insoluble form by cross-linking it on the treated surface.

EXAMPLES

Except as otherwise noted, the cigarette tobacco filler blend used in Examples 1–7 was contacted with the cross-linking agent and then heat treated in standard dispersion dryers generally known in the art as "towers". In Examples 1–6, the filler (with or without treatment with the cross-linking or stiffening agents) was exposed to high temperatures (over 260° C.) for a period of a few seconds. During these treatments, the OV value of the tobacco filler was reduced to below 6% OV. The carbon dioxide expansion processes employed herein are described, for example, in U.S. Pat. Nos. 4,235,250 and 4,258,729.

EXAMPLE 1

| Sample No. | Cross-linking agent(s) | CV cc/10.0 g | $OV_{equil}$ % |
|---|---|---|---|
| 1* | None | 39.0 | 11.5 |
| 2 | 5.0% citric acid + 2.0% DAP** | 46.2 | 11.1 |
| 3 | 3.0% succinic acid | 44.3 | 11.5 |

*Control.
**DAP = diammonium phosphate.

An application of the cross-linking agents specified followed by heat treatment with steam resulted in an increase in cylinder volume, as noted above.

EXAMPLE 2

Filler cased with 4% dextrose and 1% acetic acid solution was equilibrated to a CV of 29.2 cc/10 g and an OV of 13.8%. After a heat treatment as in Example 1, the CV increased to 44.7; the $OV_{equil}$ of the heat-treated sample was 11.7%.

EXAMPLE 3

The following samples were impregnated with liquid $CO_2$ and two of the samples were also contacted with a cross-linking agent. The samples were subsequently heat-treated with steam at about 315° C.

| Sample No. | Cross-linking agent(s) | CV cc/10.0 g | $OV_{equil}$ % |
|---|---|---|---|
| 4* | None | 71.0 | 11.0 |
| 5 | 5.0% citric acid + 2.0% DAP | 82.0 | 10.9 |
| 6 | 3.0% succinic acid | 79.8 | 10.8 |

*Control.

EXAMPLE 4

The following samples were impregnated with liquid $CO_2$ and one sample was also contacted with a cross-linking agent. The samples were subsequently heat treated with hot air at about 315° C.

| Sample No. | Cross-linking agent(s) | CV cc/10.0 g | $OV_{equil}$ % |
|---|---|---|---|
| 7* | None | 51.4 | 10.5 |
| 8 | 5.0% citric acid + 2.0% DAP | 74.3 | 11.1 |

*Control.

A comparison of the above values with those in Example 3 suggests that heat treatment with steam is somewhat superior to heat-treatment with hot air at the same temperature.

EXAMPLE 5

The following example illustrates the function of DAP for stiffening tobacco filler impregnated with $CO_2$ as in the two preceding Examples.

| Sample No. | Cross-linking agents | Heat Treatment | CV cc/10.0 g | $OV_{equil}$ % |
|---|---|---|---|---|
| 9* | None | steam | 64.0 | 11.5 |
| 10 | 5.0% citric acid + 1.0% DAP | steam | 65.0 | 12.2 |
| 11 | 5.0% citric acid + | hot air | 55.0 | 12.1 |

-continued

| Sample No. | Cross-linking agents | Heat Treatment | CV cc/10.0 g | $OV_{equil}$ % |
|---|---|---|---|---|
| | 1.0% DAP | | | |

*Control.

A comparison of the cylinder volume results for Samples 9 and 10 shows no significant difference between them. In contrast, a comparison of Sample 10 with Sample 5 (Example 3), and of Sample 11 with Sample 8 (Example 4), suggests that the use of twice the amount of DAP leads to significantly larger increases in cylinder volume.

EXAMPLE 6

Two samples are impregnated with liquid $CO_2$ and heat-treated with steam: one with no other additive (control), one impregnated before $CO_2$ treatment with 8% by weight of furfural in an aqueous solution. The sample pretreated with furfural has noticeably increased cylinder volume after reordering.

EXAMPLE 7

A cigarette filler blend was used for the treatments listed in the following table. The treatment time (30 minutes) and temperature were chosen arbitrarily. The results show that the treatment stiffened the filler after heating through cross-linking and coating. The degree of stiffening is shown by the degree of increase in filling capacity.

| Sample No. | Cross-linking agent | T °C. | CV cc/10 g | $OV_{equil}$ % |
|---|---|---|---|---|
| 12* | none | none | 36.3 | 13.0 |
| 13* | none | 125 | 40.7 | 11.3 |
| 14** | 10.0% $H_2O$ | 125 | 38.5 | 12.0 |
| 15 | 10.0% $H_2O$ + 2.0% glyoxal | 125 | 39.4 | 11.7 |
| 16 | 10.0% $H_2O$ + 2.0% glyoxal + 1.0% acetic acid | 125 | 39.9 | 11.7 |
| 17 | 10.0% $H_2O$ + 2.0% Gantrez ® 119 resin*** | 125 | 39.9 | 11.5 |
| 18** | 1% chitosan, acetate salt | 125 | 37.6 | 13.0 |
| 19** | 2% chitosan, acetate salt + 1% glyoxal | 125 | 43.8 | 11.1 |
| 20** | 1% chitosan, citrate salt | 125 | 43.8 | 11.2 |
| 21 | 1% chitosan, acetate salt + 0.5% $H_2SO_4$ | 125 | 43.0 | 11.3 |
| 22 | 2% chitosan, acetate salt + 1.2% dextrose | 125 | 42.5 | 11.4 |
| 23 | 2% chitosan, acetate salt + 2% dextrose + 1% acetic acid | 125 | 43.8 | 12.8 |

*Controls.
**Comparative.
***General Aniline and Film Corporation's trade name for copolymers of methyl vinyl ether and maleic anhydride.

EXAMPLE 8

Cross-linking agents were sprayed onto sheets of reconstituted tobacco and then the sheets were heated. The results are indicated in the following table. The cross-linking treatments produced a stiffening effect and a decrease in water sensitivity. The stiffening is exemplified by a decreased folding tensile and increased cylinder volumes. The water insensitivity is exemplified by the increased wet strength and decreased equilibrium moisture (ability to absorb water). Superior results were achieved with the addition of cross-linking additives.

| Cross-linking agent | T °C. | Tensiles, Kg/inch Dry | Wet | Folded | CV cc/10 g at $OV_{equil}$ | $OV_{equil}$ |
|---|---|---|---|---|---|---|
| none* | none | 1.53 | .06 | 1.01 | 26.6 | 14.14 |
| none* | 125 | 1.33 | .08 | .06 | 26.6 | 10.93 |
| 5% Citric Acid | 125 | 1.90 | .43 | none** | 33.7 | 9.99 |
| 5% Citric Acid + 2% DAP | 125 | 1.72 | .32 | none** | 31.9 | 10.65 |
| 2% Glyoxal | 125 | 1.64 | .25 | none** | 43.4 | 10.36 |

*Controls.
**Highly stiffened and brittle (breaking at the crease upon folding).

I claim:

1. A process for increasing and maintaining the filling power of tobacco, comprising steps (a) and (b) in any order followed by step (c):
   (a) applying an effective amount of a cross-linking agent to the tobacco;
   (b) impregnating said tobacco with an expansion agent; and
   (c) heating the tobacco containing the expansion agent and the cross-linking agent to react the cross-linking agent with the tobacco, to expand the tobacco, and to stiffen the tobacco;

wherein the tobacco is selected from the group consisting of tobacco leaf, cured tobacco leaf, tobacco filler, and reconstituted tobacco sheet; and wherein the cross-linking agent is selected from the group consisting of polyfunctional carboxylic acids, acid anhydrides of polyfunctional carboxylic acids, acid chlorides of polyfunctional carboxylic acids, carbonyl chloride, aldehydes, dialdehydes, azides, diazides, $(NH_4)_2HPO_4$, ketones, polybasic inorganic acids and salts thereof, amides, lactones, aldehydic sugars, and keto sugars.

2. A process as defined in claim 1, wherein said cross-linking agent is citric, maleic, malic, malonic, ethylenediamine tetracetic, polymannuronic, polygalacturonic, adipic, azelaic, tartaric or succinic acid.

3. A process as defined in claim 1, wherein said expansion agent is $CO_2$.

4. A process as defined in claim 1, wherein a combination of a polyfunctional carboxylic acid and $(NH_4)_2HPO_4$ is used as the cross-linking agent.

5. A process as defined in claim 4, wherein said polyfunctional acid is citric acid.

6. A process as defined in claim 1, wherein an aldehydic or keto sugar is used as the cross-linking agent.

7. A process as defined in claim 1, wherein the cross-linking agent is applied in an amount between about 0.5 and 10 weight percent relative to the tobacco.

8. A process as defined in claim 1, wherein the cross-linking agent is applied in an amount between about 1 and 5 weight percent relative to the tobacco.

* * * * *

UNITED STATES PATENT AND TRADEMARK OFFICE

CERTIFICATE OF CORRECTION

PATENT NO. : 4,532,945
DATED : August 6, 1985
INVENTOR(S) : Gus D. Keritsis

It is certified that error appears in the above-indentified patent and that said Letters Patent is hereby corrected as shown below:

On the Title page, item [22], under Related U.S. Application Data--insert item [63] Continuation-in-part of Ser. No. 420,834, Sept. 21, 1982, abandoned--.

Column 1, after the title the following should be inserted: This application is a continuation-in-part of copending United States patent application Serial No. 420,834, filed September 21, 1982, now abandoned--.

Signed and Sealed this

Seventh Day of September, 1993

Bruce Lehman

*Attest:*

BRUCE LEHMAN

*Attesting Officer*

*Commissioner of Patents and Trademarks*